US010662691B2

(12) United States Patent
Migli et al.

(10) Patent No.: US 10,662,691 B2
(45) Date of Patent: May 26, 2020

(54) HINGE HAVING HINGE CUP

(71) Applicant: Titus d.o.o. Dekani, Dekani (SI)

(72) Inventors: Carlo Migli, Lecco LC (IT); David Pecar, Pobegi (SI); Valter Svara, Izola (SI)

(73) Assignee: Titus d.o.o. Dekani, Dekani (SI)

( * ) Notice: Subject to any disclaimer, the term of this patent is extended or adjusted under 35 U.S.C. 154(b) by 223 days.

(21) Appl. No.: 15/039,926

(22) PCT Filed: Nov. 27, 2014

(86) PCT No.: PCT/EP2014/075775
§ 371 (c)(1),
(2) Date: May 27, 2016

(87) PCT Pub. No.: WO2015/078952
PCT Pub. Date: Jun. 4, 2015

(65) Prior Publication Data

US 2017/0022744 A1 Jan. 26, 2017

(30) Foreign Application Priority Data

Nov. 28, 2013 (GB) ..... 1321018.2
Aug. 15, 2014 (GB) ..... 1414548.6

(51) Int. Cl.
*E05F 5/00* (2017.01)
*E05D 11/00* (2006.01)

(52) U.S. Cl.
CPC ..... *E05F 5/006* (2013.01); *E05D 11/0054* (2013.01); *E05Y 2600/31* (2013.01);
(Continued)

(58) Field of Classification Search
CPC ..... E05F 5/006; E05F 3/20; E05D 11/0054; E05Y 2600/31; E05Y 2600/46; E05Y 2900/20; Y10T 16/304; Y10T 16/533; Y10T 16/5335; Y10T 16/5383; Y10T 16/61
(Continued)

(56) References Cited

U.S. PATENT DOCUMENTS 7,748,082 B2 * 7/2010 Harald ..... E05F 5/006 16/280
8,366,214 B2 * 2/2013 Krammer ..... E05F 5/006 16/286
(Continued)

FOREIGN PATENT DOCUMENTS

DE 202013008364 U1 10/2013
GB 2469847 A 11/2010
WO WO-2010108201 A1 * 9/2010 ..... E05F 5/006

*Primary Examiner* — William L Miller
(74) *Attorney, Agent, or Firm* — Alan D. Kamrath; Karin L. Williams; Mayer & Williams PC

(57) ABSTRACT

A hinge assembly has first and second parts pivotally connected together. One of the parts has a hinge cup (13) and is connectable to a first element such as a cupboard door. The other part is connectable to a second element such as the cupboard carcase. The assembly includes a linear damping device (17), which is actuable to provide a damped resistive force over at least part of the range of relative pivotal movement between the two hinge elements. The linear damping device (17) is conveniently mounted within the hinge cup (13).

14 Claims, 7 Drawing Sheets

(52) U.S. Cl.
CPC ..... *E05Y 2600/46* (2013.01); *E05Y 2900/20* (2013.01); *Y10T 16/304* (2015.01)

(58) Field of Classification Search
USPC ..... 16/50, 82, 286, 250, 251
See application file for complete search history.

(56) References Cited

U.S. PATENT DOCUMENTS 8,375,518 B2 * 2/2013 Haemmerle ..... E05D 3/16 16/286
8,424,161 B2 * 4/2013 Sutterlutti ..... E05F 5/006 16/286
8,561,262 B1 10/2013 Liang et al.
8,640,305 B2 * 2/2014 Pecar ..... E05F 5/006 16/50
9,003,605 B2 * 4/2015 Pecar ..... E05F 5/006 16/286
9,874,049 B1 * 1/2018 McGregor ..... E05F 3/20
2011/0019946 A1 1/2011 Krammer
2011/0291538 A1 12/2011 Brunnmayr
2012/0036678 A1 * 2/2012 Pecar ..... E05F 5/006 16/250
2013/0042431 A1 2/2013 Salice
2013/0139352 A1 6/2013 Brunnmayr
2013/0139353 A1 6/2013 Brunnmayr
2013/0139354 A1 6/2013 Brunnmayr
2013/0145580 A1 6/2013 Brunnmayr
2013/0160242 A1 * 6/2013 Brunnmayr ..... E05F 5/006 16/286
2014/0331451 A1 * 11/2014 Holzapfel ..... E05F 5/006 16/286
2014/0352111 A1 * 12/2014 Ng ..... E05F 5/02 16/286
2015/0315832 A1 * 11/2015 Wu ..... E05F 5/006 16/54
2016/0273258 A1 * 9/2016 Pecar ..... E05F 5/006
2017/0175430 A1 * 6/2017 Svara ..... E05F 5/006
2017/0241175 A1 * 8/2017 Hammerer ..... E05D 3/16
2018/0087307 A1 * 3/2018 Hammerer ..... E05D 3/06
2018/0100339 A1 * 4/2018 Kirenci ..... E05F 5/006
2018/0155974 A1 * 6/2018 Kirenci ..... E05F 5/006
2018/0209196 A1 * 7/2018 Migli ..... E05F 5/006

* cited by examiner

HINGE HAVING HINGE CUP

BACKGROUND

This invention relates to hinge assemblies.

SUMMARY

The invention provides a hinge assembly having first and second parts pivotally connected together, with one of the parts having a hinge cup and being connectable to a first element and the other part being connectable to a second element, a linear damping device, and means for actuating the damping device over at least part of the range of relative pivotal movement between the two elements. The damping device is mounted in the hinge cup.

DESCRIPTION OF THE DRAWINGS

By way of example, embodiments of the invention will now be described with reference to the accompanying drawings, in which.

DESCRIPTION

Figure 1:
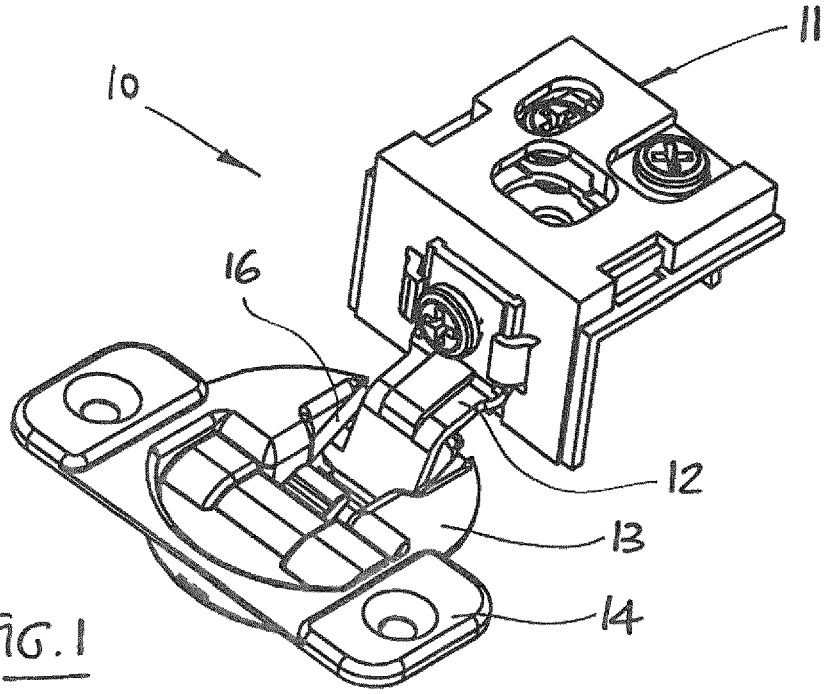
FIG. 1 shows a first form of hinge assembly according to the invention.
Figure 2:
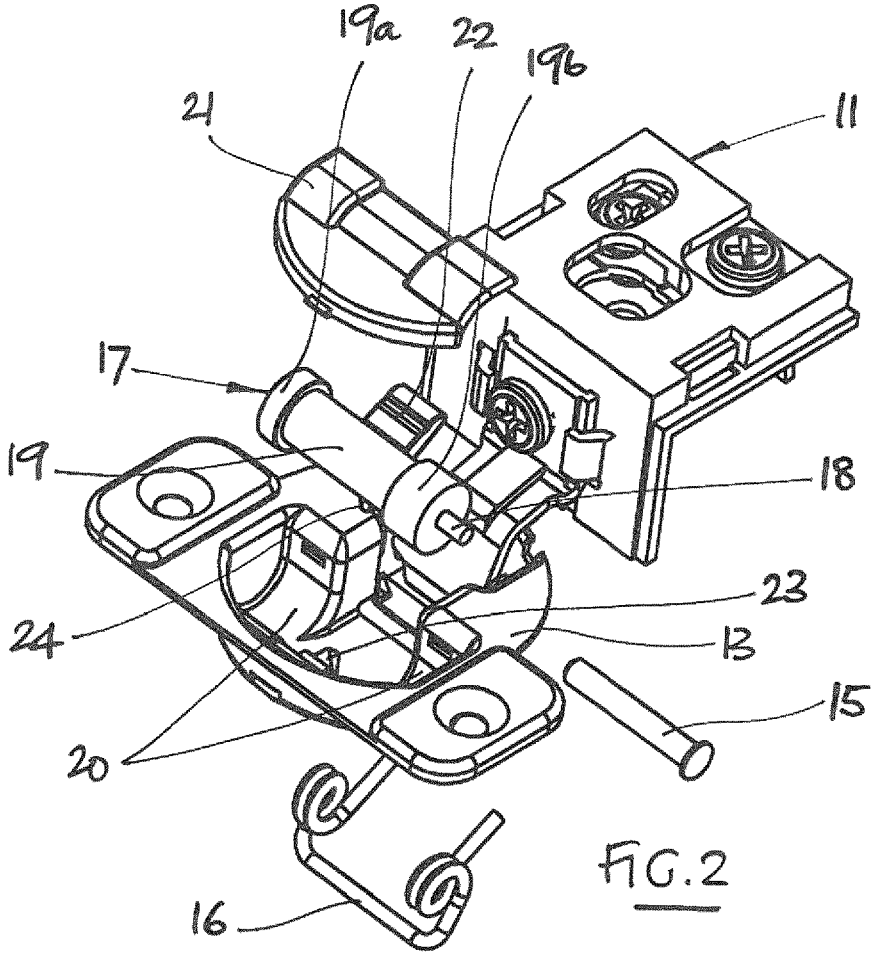
FIG. 2 is an exploded view of the hinge assembly of FIG. 1.

The hinge assembly 10 seen in FIGS. 1 and 2 is for pivotally mounting one element such as a door panel A with respect to another element such as a cupboard carcase B. The hinge assembly 10 comprises an adjustable foot assembly 11 for attachment to one of the elements, usually the cupboard carcase B. Pivotally connected to an arm 12 extending from the foot assembly 11 is a hinge cup 13 with a flange 14. The hinge cup 13 is for attachment to the other of the elements, usually the door panel A, in known manner. Conventionally, a blind hole is cut into the face of a door panel according to a standard pattern (typically using a hole of 26 mm, 35 mm or 40 mm diameter) for receiving the hinge cup, with the flange then being anchored to the face of the panel by suitable fasteners such as screws.

As is conventionally known, the hinge cup in a hinge assembly of this nature defines within itself an interior space, and the main purpose of which is to provide clearance for part of the hinge mechanism in the closed position of the door panel that it mounts. This invention seeks to make use of this interior space in the hinge cup as an opportunity for mounting a damping device within it.

Figure 3:
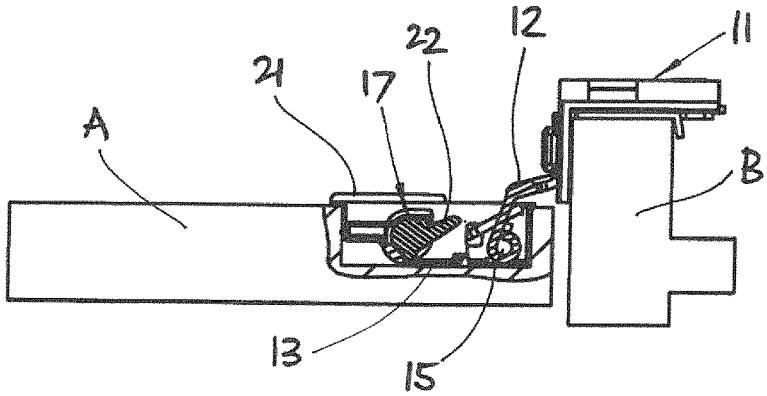
FIGS. 3, 4 and 5 show the hinge assembly of FIGS. 1 and 2 in use in a door panel mounting arrangement.
Figure 5:
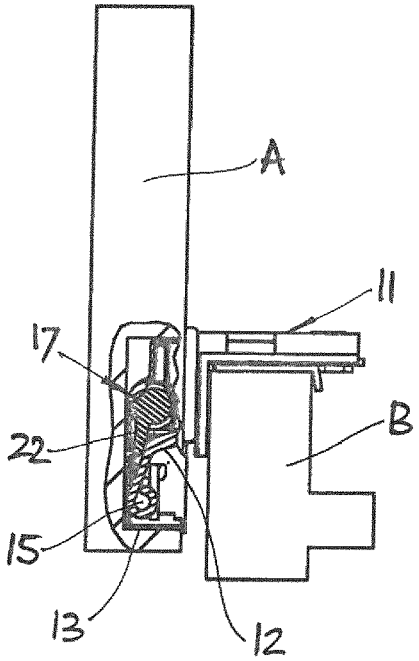

The hinge cup 13 is connected to the arm 12 via a pin 15, which forms the pivotal axis of the hinge assembly 10. As will be seen in the drawings, the pin 15 is located within the interior of the hinge cup 13, with the arm 12 thus being arranged to extend into this interior. The arm 12 is cranked to allow the hinge cup 13 to pivot through fully 90°, with the arm lying substantially within the interior of the hinge cup in the "closed" position of the assembly, as seen in FIG. 5. This allows the door panel A to lie against the face of the cupboard carcase B in the "closed" position. The arm 12 is designed to offset the pin 15 by a sufficient distance from the face of the cupboard carcase B to allow the door panel A to pivot round to its fully open position, as seen in FIG. 3. A spring 16 is mounted in the hinge cup 13 and arranged to exert a biasing force on the arm 12. The spring 16 is designed to go "over centre" as the hinge assembly 10 is moved between its open and closed positions, meaning that it acts to urge the assembly towards one or other of these positions.

A damped resistive force is applied to the pivotal movement of the hinge assembly 10 and, preferably, at least in the later stages of the closing movement of the door panel A. This damped resistive force is provided by a damping device 17, in this case a linear piston and cylinder type damper. The damping device 17 comprises a piston (not seen) arranged on a piston rod 18 for reciprocal movement in a damping medium such as silicone contained within a cylinder 19, with a spring (not seen) normally biasing the piston towards the extended position of the piston rod.

Here, the damping device 17 is designed to be mountable within the interior of the hinge cup 13. This is a particularly advantageous arrangement, because it minimises the extent to which the hinge assembly 10 protrudes and hence minimises its encroachment into the space within the cupboard.

The hinge cup 13 is provided with a pair of radiused bearing surfaces 20 for receiving the cylinder 19 of the damping device 17. The bearing surfaces 20 are aligned parallel to the axis defined by the pin 15, meaning that the axis of reciprocation of the damping device 17 will be parallel to the axis of pivotal movement of the hinge assembly 10.

The manner of engagement of the cylinder 19 with the bearing surfaces 20 is designed to allow the cylinder both to rotate about its longitudinal axis and to move along this axis relative to the hinge cup 13. The cylinder 19 preferably has collars 19*a* and 19*b* which engage the bearing surfaces 20 to facilitate this. The damping device 17 is retained in position within the hinge cup 13 by an attachable cover 21.

A wing 22 is provided extending out laterally from the cylinder 19. The wing 22 is arranged in use to protrude into the path of movement of the arm 12. The purpose of this is so that the arm 12 will strike the wing 22 during rotational movement of the hinge assembly 10 and thus cause the damping device 17 to rotate about its longitudinal axis. A mechanism is provided for converting this rotational movement of the damping device 17 into linear displacement of its cylinder 19. The mechanism comprises a cam and follower arrangement. Here, the cam is provided on the hinge cup 13 in the form of a camming surface 23 arranged extending helically with respect to the bearing surfaces 20 and the longitudinal axis of the cylinder 19. A lug 24 on the cylinder 19 is designed to engage the camming surface 23 and, as the cylinder rotates, the lug will be caused to move along its helical profile, thus causing linear displacement of the cylinder in the direction of its longitudinal axis. With the free end of the piston rod 18 arranged to abut an inner surface of the hinge cup 13, this linear displacement of the cylinder 19 effectively causes compression of the damping device 17. Compression of the damping device 17 creates a damped resistive force, and this is transmitted via the wing 22 and arm 12 to the door panel A to oppose and hence attenuate its closing movement.

It will be understood that the cam and follower arrangement described above could be provided the other way round, i.e. with the camming surface arranged on the cylinder 19 and the lug arranged on the hinge cup 13. Also, of course, the cam and follower arrangement could take different forms, for example a pair of interengaging camming profiles, and could be provided on other components, such as on the attachable cover 21 instead of on the hinge cup 13.

Figure 4:
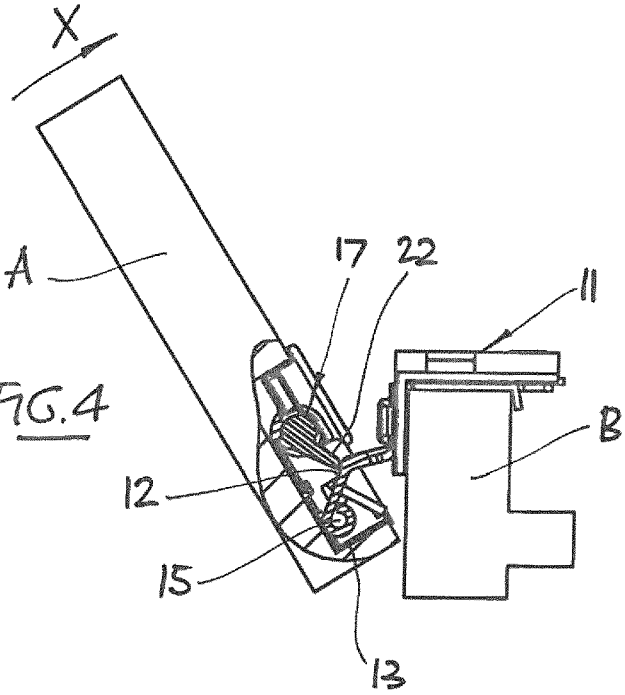

The manner of operation of the hinge assembly is seen in FIGS. 3, 4 and 5. In FIG. 3, the door panel A is in its open position. FIG. 4 shows the door panel A part way into its closing movement (in the direction of arrow X), and here it will be seen how the cranked arm 12 has come into engagement with the wing 22. In FIG. 5, the door panel A is in its closed position, and the cranked arm 12 has caused the wing 22 to rotate fully round.

It will be understood that there is only a relatively small range of rotational movement available for the wing in this arrangement, and hence also for the damping device. Therefore, in order to provide sufficient linear movement of the damping device, the movement converting mechanism has to be fairly highly geared. For example, this might be arranged to provide 0.1 mm of linear displacement of the damping device 17 per degree of its rotation, and the range of rotational movement of the damping device will typically be around 30°.

The gearing of the movement converting mechanism can be varied by varying the pitch of the camming surface, and it will be appreciated that this can be tailored to suit any number of different situations. For example, the pitch can be made to vary over the extent of the camming surface, so that the damping resistance will change over the rotational range of the hinge assembly.

Figure 6:
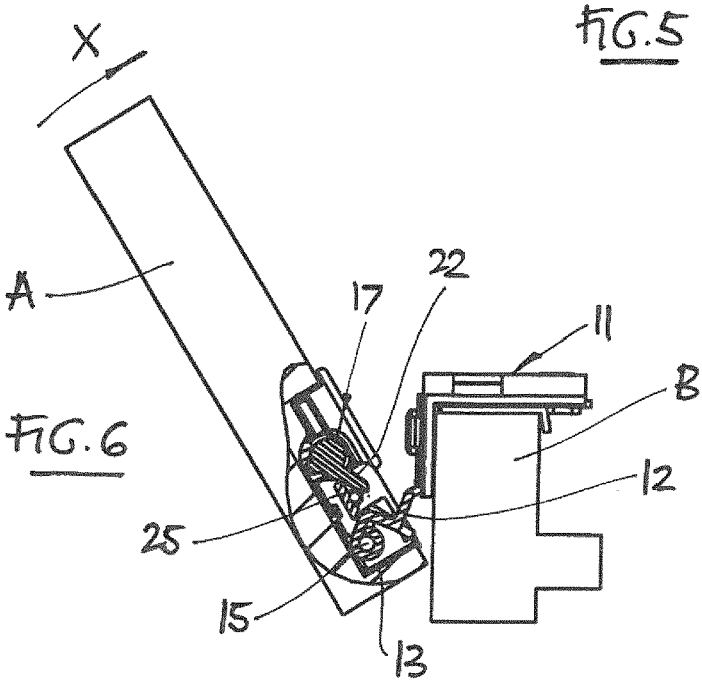
FIG. 6 shows the hinge assembly of FIGS. 1 and 2 in use in an alternative door panel mounting arrangement.

The arrangement in FIG. 6 is essentially similar to the arrangement of FIGS. 3, 4 and 5. Here, however, an intermediate pivotal link 25 is interposed between the cranked arm 12 (which in this case has a slightly different shape) and the wing 22. The effect of the pivotal movement of the door panel A in its closing movement (in the direction of arrow X) in this example is again to produce rotational movement of the wing 22, and hence the damping device 17, but in the opposite direction. In this case, therefore, the configuration of the cam and follower arrangement of the movement converting mechanism is essentially reversed.

The intermediate link to reverse the direction of rotation of the damping device 17, which here is the pivotal link 25, could take other forms such as for example a cam. This could be geared to produce a different amount of rotational movement of the damping device per degree of rotation of the hinge assembly.

Figure 7:
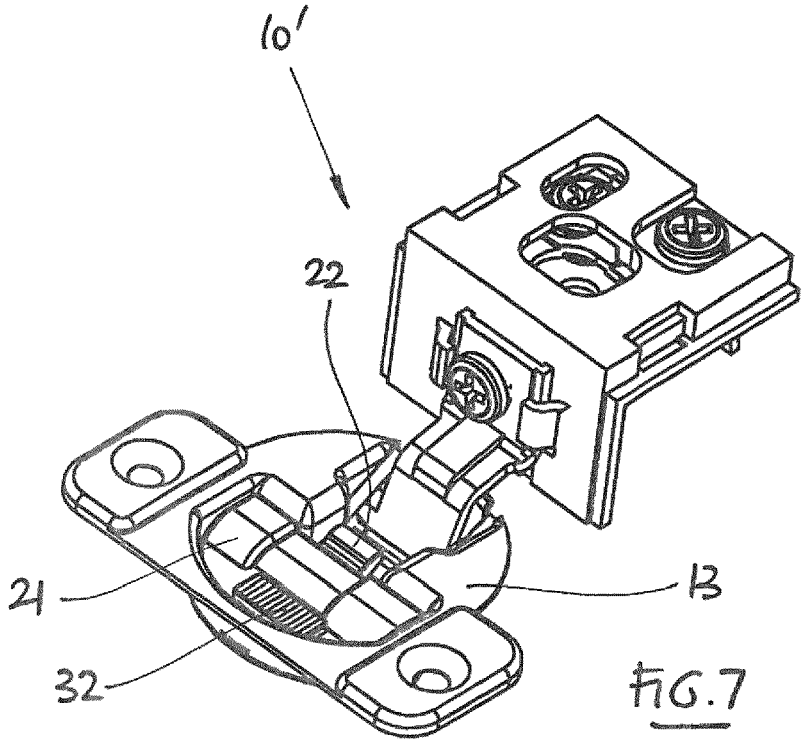
FIG. 7 shows a second form of hinge assembly according to the invention.
Figure 8:
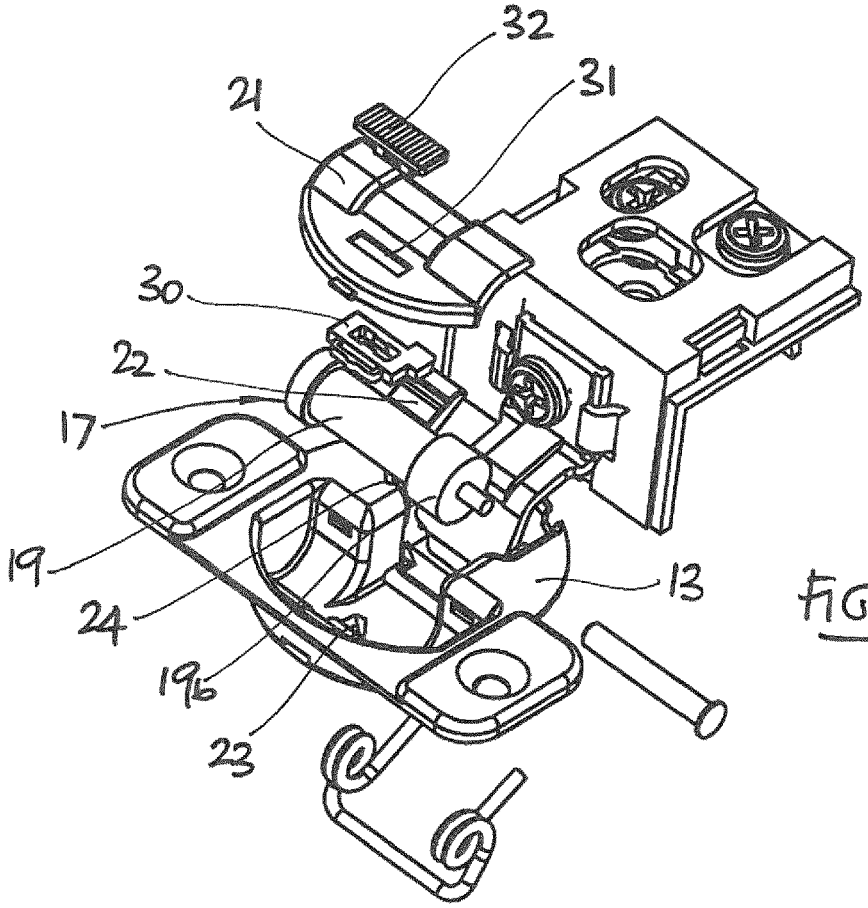
FIG. 8 is an exploded view of the hinge assembly of FIG. 7.

The hinge assembly 10' seen in FIGS. 7 and 8 is essentially similar to that of FIGS. 1 and 2. Here, however, a mechanism is provided for enabling adjustment of the damping device 17. The adjusting mechanism takes the form of a movable end stop 30 which fits within the interior of the hinge cup 13 and engages one of the collars **19*b* on the cylinder 19. The collar 19*b* is pressed into abutting engagement with the moveable end stop 30 by the action of the spring within the cylinder 19. The moveable end stop 30 is movably mounted on the attachable cover 21 via an elongate slot 31 and is held in place by a clip 32 which fastens to it from the outer side of the cover. Moving the clip 32 along the slot 31 adjusts the position of the moveable end stop 30 and hence the position of the cylinder 19 with respect to the hinge cup 13. This in turn adjusts the position of the lug 24 with respect to the camming surface 23, which therefore alters the angle of orientation of the wing 22. This affects the point during the closing movement of the door panel A at which the wing 22 is struck by the cranked arm 12**.

Figure 9:
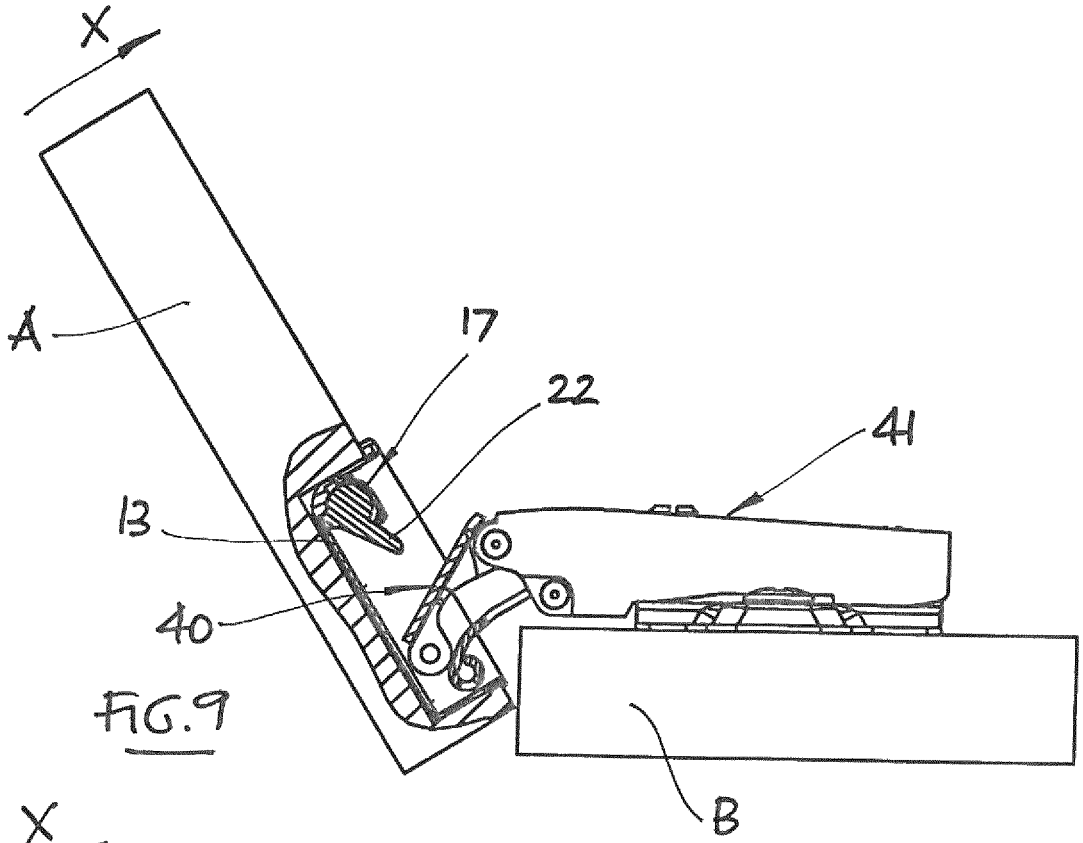
FIG. 9 shows a third form of hinge assembly in use in a door panel mounting arrangement.
Figure 10:
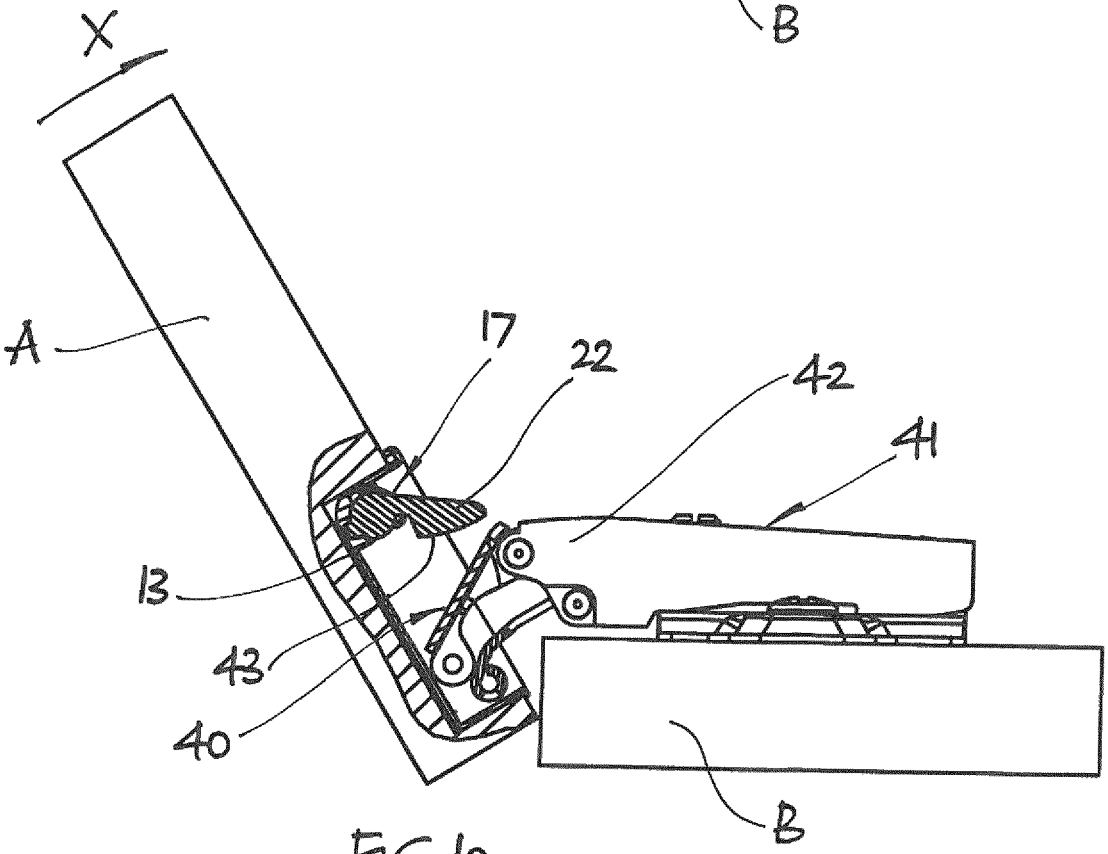
FIG. 10 shows a fourth form of hinge assembly in use in a door panel mounting arrangement.
Figure 11:
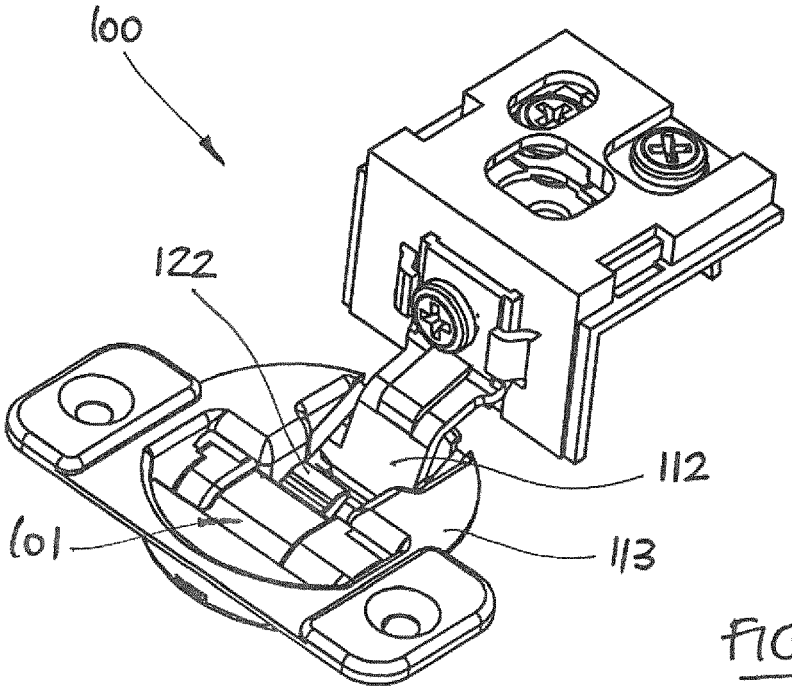
FIG. 11 shows a fifth form of hinge assembly according to the invention.
Figure 12:
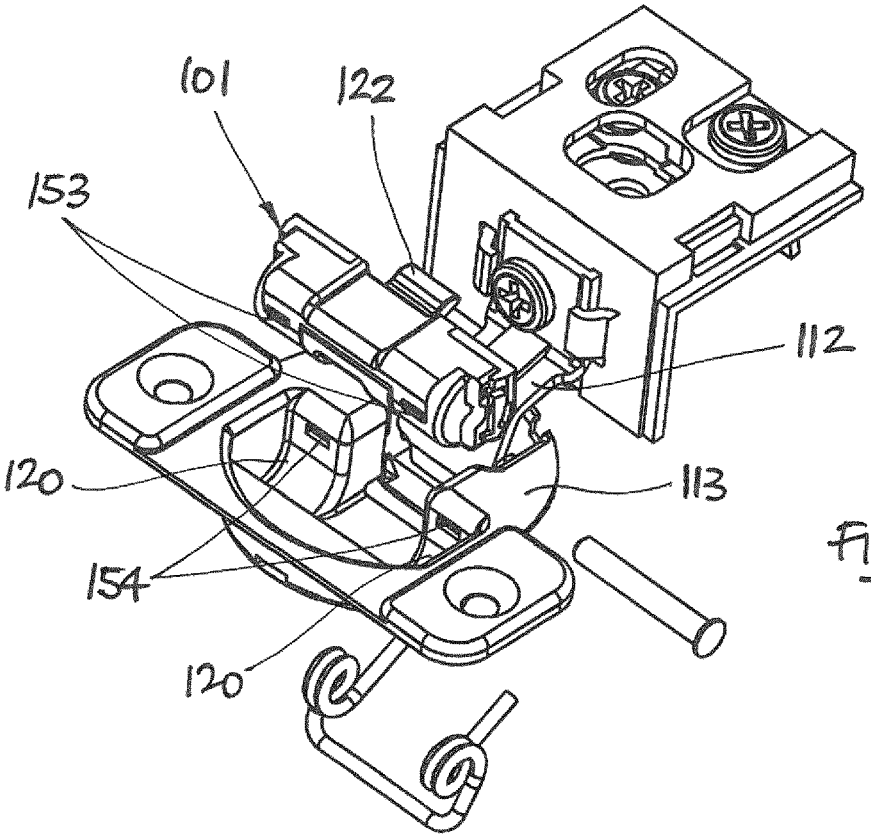
FIG. 12 is an exploded view of the hinge assembly of FIG. 11.
Figure 13A:
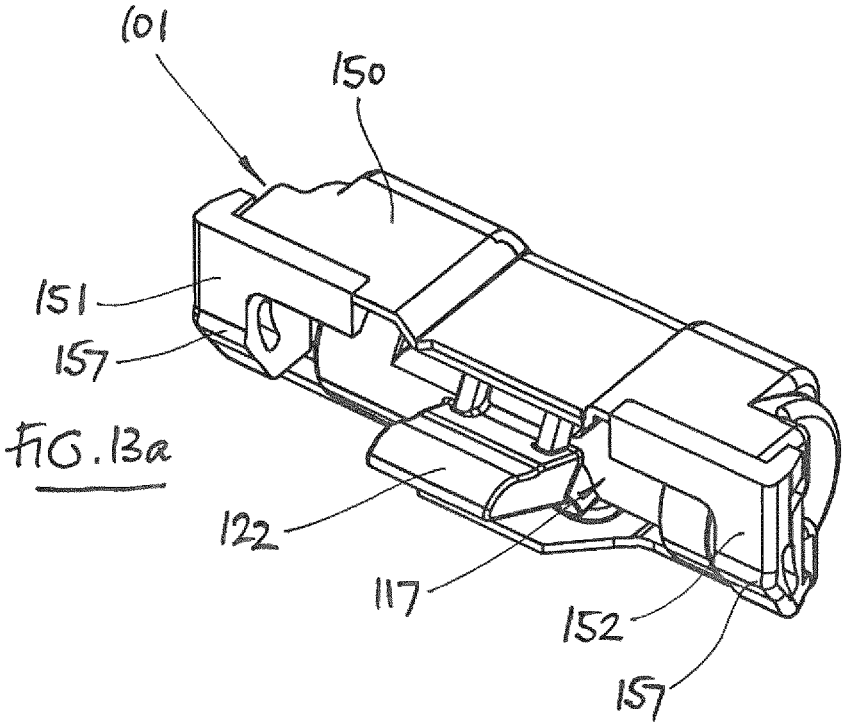
FIG. 13*a* shows the damping mechanism sub-assembly of the hinge assembly of FIG. 11.
Figure 13B:
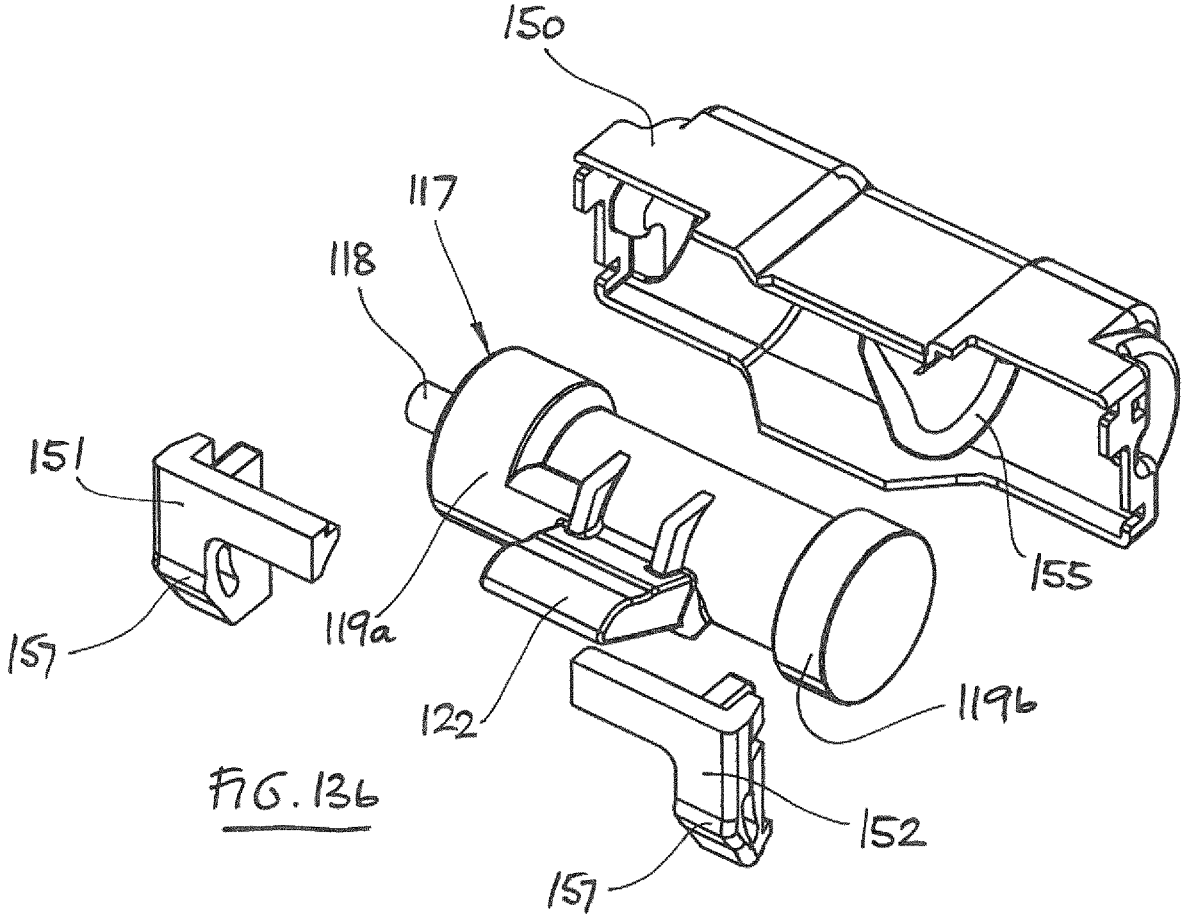
FIG. 13*b* shows the damping mechanism sub-assembly in an exploded view.
Figure 14:
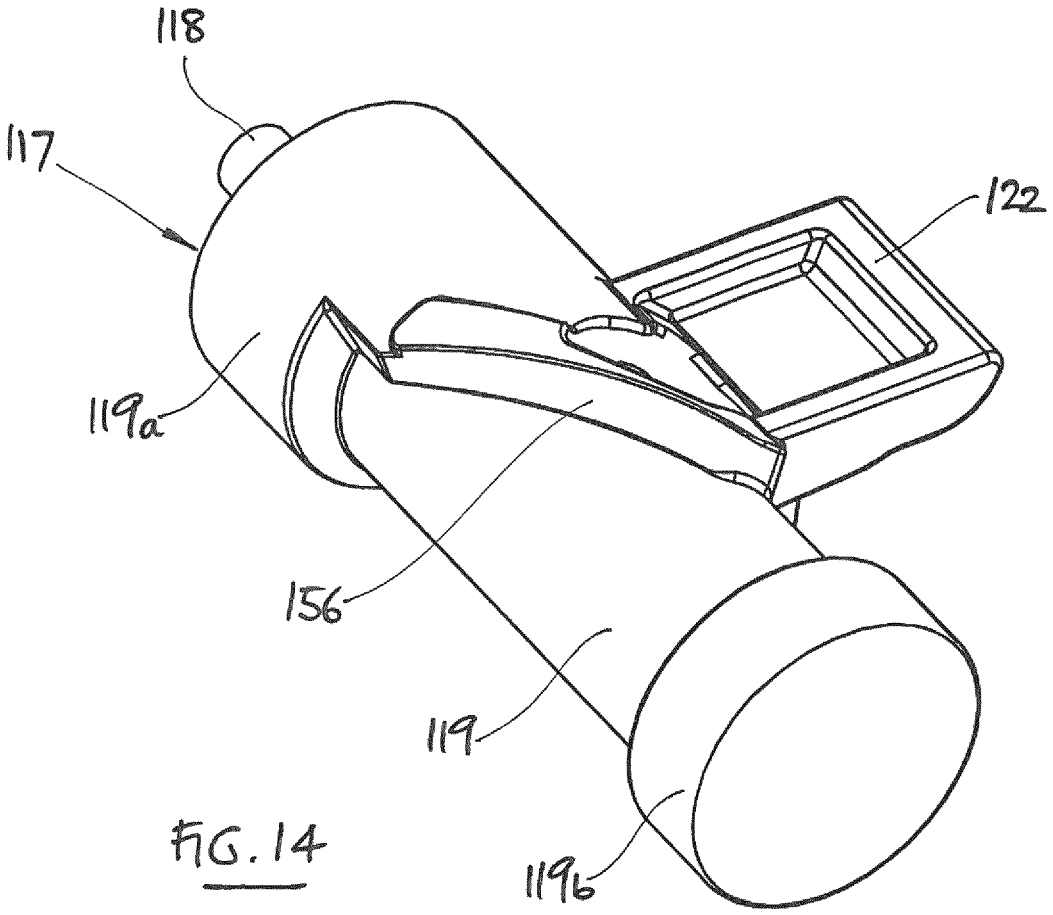
FIG. 14 shows the damping device of the hinge assembly of FIG. 11.

FIGS. 9 and 10 illustrate the use of a similar form of damper arrangement with a toggle type hinge. Instead of having a single pivotal axis, toggle type hinges have a compound linkage which creates multiple parallel pivotal axes. Nevertheless, the principles of operation are essentially the same. In the arrangement of FIG. 9, therefore, the wing 22 of the damping device 17 is arranged to be engaged by the compound linkage 40 of the toggle type hinge 41 during its closing movement (in the direction of arrow X). This causes the wing 22 and hence the damping device 17 to rotate. Rotation of the damping device 17 causes it to be compressed, through the action of the movement converting mechanism, thereby delivering a damped resistive force to the closing movement of the door panel A.

The arrangement seen in FIG. 10 is essentially the same as in FIG. 9, except that the compound linkage 40 and/or the hinge arm 42 here are designed to engage the underside of the wing 22, thus causing its manner of rotation to be in the opposite direction. In this case, therefore, the configuration of the movement converting mechanism is essentially reversed. Also, the underside of the wing 22 in this example has a cam profile 43. However, the net effect is still to cause compression of the damping device 17 and hence generation of a damped resistive force to the closing movement of the door panel A.

In the examples shown in FIGS. 1 to 5 and 7 to 9, it will be seen that the wing 22 on the damping device 17 is arranged to be pivoted downwardly in the interior of the hinge cup 13 by the closing movement of the hinge assembly. Thus, the wing 22 will always be within the confines of the interior space defined by the hinge cup 13. In contrast, the wing 22 in the examples shown in FIGS. 6 and 10 is arranged to be pivoted in the opposite direction. An advantage of this latter kind of arrangement is that it can allow a greater range of pivotal movement of the wing. In the example of FIG. 10, however, the wing 22 will protrude outside the confines of the interior space defined by the hinge cup 13. This might also be the case with the example of FIG. 6, although to a lesser extent.

The hinge assembly 100 seen in FIGS. 11 to 14 is again essentially similar to the hinge assemblies described above. Here, however, the damping mechanism is conveniently provided in the form of a self-contained sub-assembly 101, which is itself mountable within the interior of the hinge cup 113 as a unit.

The component parts of the sub-assembly 101 are seen in exploded view in FIG. **13*b*. They comprise a damping device 117, a holder 150, conveniently of pressed steel, and two retaining clips 151, 152. The damping device 117 comprises a piston (not seen) arranged on a piston rod 118 for reciprocal movement in a damping medium such as silicone contained within a cylinder 119**, with a spring (not seen) normally biasing the piston towards the extended position of the piston rod.

The cylinder 119 has a wing 122 extending out therefrom. This is for engaging the hinge arm 112, as will be described in more detail below. The damping device 117 is located within the holder 150 and is held in position there by the two retaining clips 151, 152, which attach to the holder by suitable ways such as snap connectors. The cylinder 119 has bearing surfaces 119*a*, 119*b* such as collars at its ends. These are designed to act as bearing surfaces for the movement of the damping device 117, which will be both rotational about its longitudinal axis and linearly along this axis. Here, the bearing surfaces 119*a*, 119*b* are arranged to engage with radiused surfaces 120 on the base of the hinge cup 113 when the sub-assembly 101 is in position. However, the bearing surfaces 119*a*, 119*b* could be arranged instead to engage surfaces provided elsewhere, for example on the holder 150 and/or the retaining clips 151, 152.

The damping mechanism sub-assembly 101 is mountable in the hinge cup 113 by simple insertion. A pair of lugs 153 on the outer surface of the holder 150 (see FIG. 12) are engagable in a pair of corresponding slots (not shown) in the sidewall of the hinge cup 113 opposite to the hinge arm 112. With the lugs 153 in position, the sub-assembly 101 can then be pivotted, with the lugs effectively acting as a fulcrum, until a pair of ramped projections 157 provided on the retaining clips 151, 152 on the opposite side of the holder 150 spring into engagement with another pair of slots 154 on the opposite sidewall of the hinge cup 113 adjacent to the hinge arui 112.

When it is in position, the damping mechanism sub-assembly 101 is contained essentially within the interior space defined by the hinge cup 113. In this position, the wing 122 on the cylinder 119 protrudes out of the holder 150 and extends into the path of movement of the hinge arm 112.

The hinge arm 112 is designed to come into contact with the wing 122 towards the end of the closing movement of the door which the hinge assembly mounts. The movement of the hinge arm 112 as the door closes acts on the wing 122 and causes the cylinder 119 to rotate about its longitudinal axis. A movement conversion mechanism converts this rotational movement of the cylinder 119 into linear displacement of it along its longitudinal axis. Specifically, the cylinder 119 is caused to be displaced in a direction towards the free end of the piston rod 118. The free end of the piston rod 118 is in abutting engagement with the holder 150 and/or retaining clip 151. Accordingly, this linear movement of the cylinder 119 effectively causes compression of the damping device 117. The damped resistance to this compression that the damping device 117 produces is transmitted back to the door via the wing 122 and hinge arm 112, thereby damping its closing movement.

The movement conversion mechanism takes the form of a cam and follower device. In particular, a helically extending camming surface 155 is provided on the inside of the holder 150. This is designed to be engaged by a corresponding helically extending camming surface 156 on the outside of the cylinder 119 (see FIG. 14).

It will be understood that one or other of these camming surfaces could be replaced by a protrusion such as a pin, which would effectively give point contact with the camming surface that it engages. An advantage of this arrangement is that it is then possible to vary the pitch of the camming surface. By varying the pitch of the camming surface, the damping mechanism will produce a variable damped resistive force over its working stroke.

The manner of mounting of the damping mechanism sub-assembly 101 in the hinge cup 113 is designed to enable it to withstand the forces that will act upon it. Specifically, when the hinge arm 112 acts on the wing 122 as the door closes, this will cause the sub-assembly to experience a torque force tending to prise it out of the hinge cup 113. The slots in the sidewall of the hinge cup 113 are able to act effectively as stop surfaces which prevent movement of the lugs 153 on the holder 150 that engage them and hence provide positive resistance to this torque force.

The invention claimed is:

1. A hinge assembly comprising:

first and second parts pivotally connected together about a pivot axis, with the first part being connectable to a first element and the second part being connectable to a second element, with the first part configured to be mounted in a blind hole cut into a face of the first element, with the first part having a hinge cup and a flange, with the hinge cup configured to be received in the blind hole and the flange configured to be anchored to the face of the first element;

a linear damping device having linear movement along a longitudinal axis extending parallel to the pivot axis, wherein the hinge cup defines an interior space and the linear damping device remains contained within the confines of the interior space, with the linear damping device configured to be located below the face of the first element; and means for actuating the linear damping device over at least part of the range of relative pivotal movement between the two elements.

2. A hinge assembly as claimed in claim 1 further comprising a mechanism for converting pivotal movement of the first and second parts into the linear movement of the linear damping device.

3. A hinge assembly as claimed in claim 2 wherein the movement converting mechanism is in the form of a cam and a follower.

4. A hinge assembly as claimed in claim 3 further including a cover for retaining the linear damping device in position in the interior space of the hinge cup.

5. A hinge assembly as claimed in claim 4 wherein one of the cam and follower is provided on the linear damping device and the other of the cam and follower is provided on the cover.

6. A hinge assembly as claimed in claim 3 wherein one of the cam and follower is provided on the linear damping device and the other of the cam and follower is provided in the hinge cup.

7. A hinge assembly as claimed in claim 2 wherein the linear damping device is mounted within a sub-assembly mountable within the interior space of the hinge cup.

8. A hinge assembly as claimed in claim 7 wherein the movement converting mechanism acts between the linear damping device and the sub-assembly.

9. A hinge assembly as claimed in claim 8 wherein the sub-assembly is mountable within the hinge cup by a resilient snap connection.

10. A hinge assembly as claimed in claim 9 wherein the sub-assembly comprises a mounting that includes a mounting stop surface on a part of the sub-assembly held by a hinge cup stop surface on the hinge cup, with engagement of said mounting stop surface with said hinge cup stop surface resisting pivotal movement of the sub-assembly in one direction.

11. A hinge assembly as claimed in claim 1 wherein the linear damping device is arranged to be rotatable about the longitudinal axis.

12. A hinge assembly as claimed in claim 1 further including a mechanism for adjusting onset of a damped resistive force to be generated by the linear damping device.

13. A hinge assembly as claimed in claim 1 wherein the linear damping device comprises a wing moveable downwardly in the interior space for actuating the linear damping device.

14. A hinge assembly as claimed in claim 1 wherein the linear damping device comprises a wing moveable upwardly in the interior space for actuating the linear damping device.

* * * * *